United States Patent [19]

Noordegraaf et al.

[11] Patent Number: 5,002,115

[45] Date of Patent: Mar. 26, 1991

[54] CENTRIFUGAL CASTING OF METAL MATRIX COMPOSITES

[75] Inventors: Jan Noordegraaf; Wilfred H. H. Alsem; Cornelis J. R. Groenenberg; Cornelis Rensen, all of At Arnhem, Netherlands

[73] Assignee: Shell Internationale Research Maatschappij B.V., The Hague, Netherlands

[21] Appl. No.: 375,412

[22] Filed: Jul. 5, 1989

[30] Foreign Application Priority Data

Jul. 5, 1988 [NL] Netherlands ..... 8801701

[51] Int. Cl.[5] ..... B22D 19/14; B22D 13/00

[52] U.S. Cl. ..... 164/97; 164/114; 164/288

[58] Field of Search ..... 164/97, 114, 288, 108

[56] References Cited

U.S. PATENT DOCUMENTS

| | | | |
|---|---|---|---|
| 2,435,227 | 2/1948 | Lester | 164/114 |
| 3,547,180 | 12/1970 | Cochran et al. | 164/97 |
| 4,279,289 | 7/1981 | Ban et al. | 164/97 |
| 4,610,693 | 9/1986 | Niwa et al. | 164/97 |

FOREIGN PATENT DOCUMENTS

| | | | |
|---|---|---|---|
| 57-104729 | 12/1983 | Japan | 164/98 |
| 60-148659 | 8/1985 | Japan | 164/98 |
| 62-259660 | 11/1987 | Japan | 164/97 |
| 492351 | 12/1975 | U.S.S.R. | 164/97 |

*Primary Examiner*—Richard K. Seidel
*Assistant Examiner*—Rex E. Pelto
*Attorney, Agent, or Firm*—Jones, Tullar & Cooper

[57] ABSTRACT

A process for the casting of shaped objects by subjecting a mould to a centrifugal acceleration directed to the bottom of the mould and introducing a molten pure metal or alloy into the mould, wherein a dispersed filler is placed before adding the melt, which filler is retained immovably during the addition of the melt by using a cover plate.

11 Claims, 1 Drawing Sheet

CENTRIFUGAL CASTING OF METAL MATRIX COMPOSITES

BACKGROUND OF THE INVENTION

The invention relates to a process for casting shaped objects. The invention relates particularly to the centrifugal casting of metal matrix composites. To this end, a molten pure metal or alloy is introduced into a mould which is subjected to a centrifugal acceleration directed to the bottom of the mould. A dispersed filler has previously been placed in the mould. The filler is any filler commonly used for making composites, i.e. one which can enhance properties such as tensile strength, bending strength, elasticity, sound absorption or wear resistance.

Such a process is known from WEAR 81 (1982), page 209–220, authors J. Sugishita et al. The filler used in this process is graphite. The aim was to improve the wear resistance of aluminium. After a small quantity of graphite granules (diameter $4\times10^{-8}$ m) had been placed in a tubular mould and a quantity of molten aluminium was introduced into the mould, the mould was spun. The described experiments were designed to obtain a cylindrical casting in which the graphite particles were only to be found at the outside of the shaped object. The core contains no filler. This is referred to by the authors as "partial dispersion" of the filler. The molten aluminium running in under the influence of the high acceleration pushes the graphite particles away, so that they as it were, run "up" along the wall (see 1.*c* FIG. 13 *a–d*) in a direction opposite to that of the acceleration.

The object of the present invention is to make shaped objects in which the filler is dispersed as homogeneously as possible throughout the entire metal matrix. This is achieved by preventing, as far as possible, the filler from moving during the filling of the mould with pure metal or alloy. The invention therefore relates to a process for the casting of shaped objects by subjecting a mould to a centrifugal acceleration directed to the bottom of the mould and introducing a molten pure metal or alloy into the mould, wherein a dispersed filler is placed before adding the melt, characterized in that the filler is retained immovably during the addition of the melt.

The simplest way of preventing movement of the filler while the pure metal or alloy runs in is to place it in the mould at such a packing density, e.g. by prior compression, vibrational compacting, or sintering the filler with the aid of a binder, that the filler is held in place by being gripped between the mould walls during pouring.

In addition, the packing shape can be maintained by retaining the filler under a cover plate. The density of the cover plate is preferably greater than the density of the molten metal. This enables fillers with both a lower and a higher density than that of the molten metal to be simply used. If the cover plate rests on the filler, the high acceleration to which the cover plate is subjected during centrifuging causes it to press the filler with great force in the direction of the space filled with filler. The pressing effect is of course greater the greater the mass of the cover plate. The density of the filler can be varied by varying the mass of the cover plate. The cover plate can also rest on a support provided in the mould. In that case, movement of the filler is prevented without compression taking place.

The cover plate does not need to fit closely against the wall of the mould. Some tolerance between the wall and the cover plate enables molten metal to be introduced into the mould. Moreover, some tolerance is desirable for easy movement of the cover plate, as well as for venting away air present in the filler. On the other hand. excessive tolerance is not desirable, since the edges of the filler should also be well pressed down.

Besides the addition of the melt through the clearance between the wall and the cover plate, one or more apertures can be made in the cover plate or one or more grooves can be made on the circumference of the cover plate. Depending on the particle shape and size of the filler, it may be advantageous to fit a gauze structure between the cover plate and the filler in order to prevent escape of the filler. If the tolerance is very small, the cover plate will be provided with at least one channel through which melt can flow into the mould under the influence of the centrifugal acceleration.

The filler can be used in any suitable form, e g. as granules, powder, flakes, granulate, staple fibres, continuous filaments, woven or non-woven fabrics or preforms. Good fillers are silicon carbide, silicon oxide, aluminium oxide and carbon.

The process according to the present invention can, in principle, be applied for all pure metals and alloys. In particular, the process is used for casting zinc, aluminium and alloys of these metals, for example, Al/Mg, Al/Si and Zn/Al/Mg.

In the casting process according to the invention, large centrifugal accelerations are employed, viz. at least 100 g ($g=9.81$ m/s$^2$), preferably 400 to 1500 g. This is desirable in order to obtain sufficient penetration of all cavities between the filler particles and, at the same time, drive out all air. For fillers with a particle size of less than 1 μm, it is desirable to employ a centrifugal acceleration of at least 1500 g in order to achieve good infiltration. The packing density of the filler in the mould has a considerable effect on the volume fraction of filler in the composite material obtained after cooling. The degree of filling will, as a rule, be above 70% v and is therefore affected by the shape of the particles.

The occurrence of shrinkage cavities in the castings during cooling after pouring and solidification can be prevented by employing a mould having a bottom which is not thermally insulated or may even consist of a plate with a high thermal conductivity, while the other wall or walls are thermally insulated. This causes directional solidification to take place, so that additional feeding of the melt is always possible. The thermal insulation material may be a ceramic material. In order to prevent premature solidification of the molten metal, it is recommended that the mould be preheated.

DESCRIPTION OF THE PREFERRED EMBODIMENT

EXAMPLE 1

Zinc reinforced with silicon carbide particles

Figure 1:
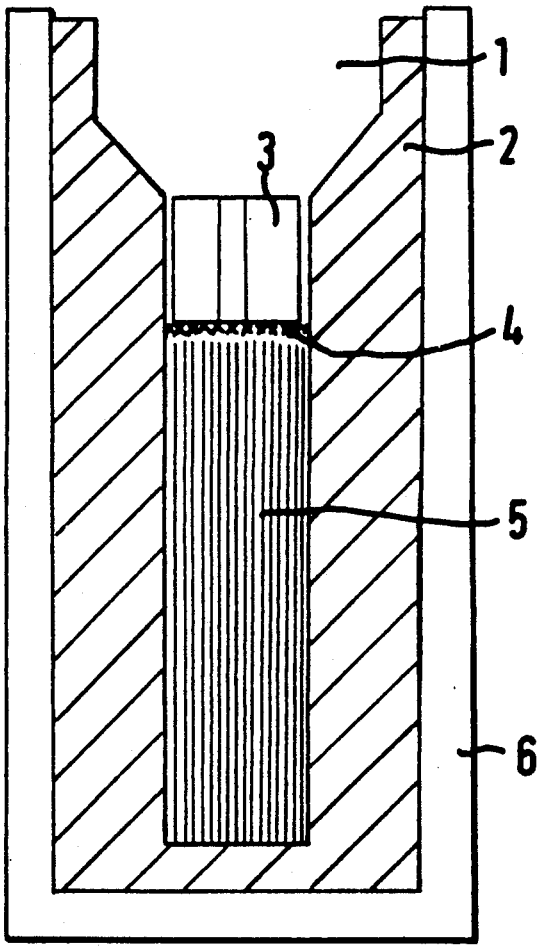
FIG. 1 is a side view of the centrifugal casting mold.

The mould employed is shown schematically in FIG. 1. The mould 2 was made by drilling out a solid block of graphite. It was partly filled with SiC particles 5 (8–32 μm, s.g. 3.21 g/cm$^3$). A cover plate 3 of molybdenum (s.g. 10.2 g/cm$^3$) provided with a vertical channel was laid on the particles. A stainless steel gauze 4 with a mesh size of 45 μm was attached to the bottom of the cover plate. The mould, containing the SiC particles and the cover plate, was heated up in an air circulation oven to 550° C. Liquid zinc (s.g. 7.14 g/cm$^3$) at 500° C. was then poured from a melting furnace into the space 1 above the cover plate. The mould with contents was placed in an insulated beaker 6 with a cooling plate at the bottom in a centrifuge (make: Heraeus, model: Cryofuge 8000)

Under the influence of the centrifugal acceleration, at 3000 rpm, with a distance between the axis of rotation and the top of the beaker of 14 cm, the melt was forced into the cavities between the particles. After cooling, longitudinal and transverse cross sections of the resulting composite (20×80 mm) were made. These were examined under an optical microscope and in all cases a homogeneous dispersion of the SiC particles was observed in a pore-free zinc matrix.

EXAMPLE 2

Aluminium reinforced with continuous fibres of silicon carbide

The mould employed is also shown schematically in FIG. 1, but instead of the drilled-out block of graphite 2, a pre-formed refractory material is used. Such moulds of refractory material are used particularly when non-cylindrical or asymmetrical products are desired, since it is not possible to use multi-part moulds for centrifugal casting. The mould is made as follows:

- the desired final shape is made in a multi-part master mould,
- the master mould is filled with a low melting point alloy (approx. 150° C.),
- after cooling, the casting is removed and placed in a steel tube closed at one end,
- the steel tube is filled with refractory material (Norton Cement),
- after the cement has been dried at approx. 110° C., the tube is heated to about 160° C. and the alloy poured out,
- the resulting mould is sintered at about 850° C.

The mould was partly filled with SiC fibres (s.g 2.56 g/cm$^3$). A molybdenum (s.g 10.2 g/cm$^3$) cover plate provided with a vertical channel was laid on the fibres.

The mould containing SiC fibres and cover plate was heated in an air circulation furnace to 750° C. Molten and degassed aluminium (s.g. 2.7 g/cm$^3$) was then poured from a melting furnace onto the cover plate. The mould and contents were placed in an insulated beaker with a cooling plate at the bottom in a centrifuge (make: Heraeus, model: Cryofuge 8000).

Under the influence of the centrifugal acceleration, at 3000 rpm and with a distance between the axis of rotation and the top of the beaker of 14 cm, the melt was forced into the space between the fibres. After the resulting composite (5×12×100 mm) had cooled, longitudinal and transverse cross sections were made. These were examined under an optical microscope and in all cases a homogeneous distribution of the SiC fibres was observed in a pore-free aluminium matrix.

We claim:

1. A process for the casting of shaped objects, comprising the steps of: placing a dispersed filler into a mould; introducing a molten pure metal or alloy into the mould; subjecting the mould and its contents to a centrifugal acceleration directed to the bottom of the mould; retaining the filler immovable during the introduction of the molten pure metal or alloy; and holding the dispersed filler at a maximum packing density during the centrifugal acceleration with a cover plate.

2. The process according to claim 1, further comprising the step of: providing the mould with thermally insulated wall or walls and a non-thermally insulated bottom.

3. The process according to claim 1, wherein the molten pure metal or alloy comprises zinc, aluminum or an alloy thereof.

4. The process according to claim 1, wherein the dispersed filler comprises silicon carbide, silicon oxide, aluminum oxide or carbon.

5. The process according to claim 1, further comprising the step of: providing the cover plate with one or more channels for the addition of the molten pure metal or alloy.

6. The process according to claim 1, further comprising the step of: providing the mould with thermally insulated wall or walls and a non-thermally insulated bottom.

7. The process according to claim 6, wherein the molten pure metal or alloy comprises zinc, aluminum or an alloy thereof.

8. The process according to claim 6, wherein the dispersed filler comprises silicon carbide, silicon oxide, aluminum oxide or carbon.

9. The process according to claim 1, wherein the molten pure metal or alloy comprises zinc, aluminum or an alloy thereof.

10. The process according to claim 1, wherein the dispersed filler comprises silicon carbide, silicon oxide, aluminum oxide or carbon.

11. A process for the casting of shaped objects, comprising the steps of: placing a dispersed filler into a mould; introducing a molten pure metal or alloy into the mould; subjecting the mould and its contents to a centrifugal acceleration directed to the bottom of the mould; and retaining the filler immovable during the introduction of the molten pure metal or alloy by means of a retaining means arranged between the filler and the molten pure metal or alloy.

* * * * *